US011594388B2

(12) United States Patent
Hirayama et al.

(10) Patent No.: US 11,594,388 B2
(45) Date of Patent: Feb. 28, 2023

(54) APPARATUS AND METHOD FOR INHIBITING ELECTROMAGNETIC RELAY FROM BEING FROZEN

(71) Applicant: Prime Planet Energy & Solutions, Inc., Tokyo (JP)

(72) Inventors: Atsushi Hirayama, Suita (JP); Masahiro Sata, Kasai (JP); Masato Nishikawa, Kakogawa (JP); Kimihiko Furukawa, Kakogawa (JP); Katsuhiro Arinobu, Takasago (JP); Taketoshi Yoshikane, Kasai (JP)

(73) Assignee: PRIME PLANET ENERGY & SOLUTIONS, INC., Tokyo (JP)

( * ) Notice: Subject to any disclaimer, the term of this patent is extended or adjusted under 35 U.S.C. 154(b) by 0 days.

(21) Appl. No.: 17/506,679

(22) Filed: Oct. 21, 2021

(65) Prior Publication Data

US 2022/0130629 A1 Apr. 28, 2022

(30) Foreign Application Priority Data

Oct. 23, 2020 (JP) ..... JP2020-177759

(51) Int. Cl.
*H01H 45/12* (2006.01)
*H01H 47/00* (2006.01)

(52) U.S. Cl.
CPC ..... *H01H 45/12* (2013.01); *H01H 47/001* (2013.01)

(58) Field of Classification Search
CPC ..... H01H 45/12; H01H 47/001–2047/006
See application file for complete search history.

(56) References Cited

U.S. PATENT DOCUMENTS

2013/0181732 A1* 7/2013 Szleszynski ..... H01H 47/002 324/750.03
2014/0340808 A1 11/2014 Kurita et al.

FOREIGN PATENT DOCUMENTS

| | | | |
|---|---|---|---|
| JP | H5246342 | A | 9/1993 |
| JP | H114377 | A | 1/1999 |
| JP | 2007165406 | A | 6/2007 |
| JP | 4445523 | B2 | 4/2010 |
| JP | 2013136874 | A | 7/2013 |
| JP | 2019183647 | A | 10/2019 |

* cited by examiner

*Primary Examiner* — Ramon M Barrera
(74) *Attorney, Agent, or Firm* — Hauptman Ham, LLP

(57) ABSTRACT

A control unit includes: an input portion that receives the positional information of a vehicle; a calculation unit that generates a control signal for controlling an electromagnetic relay; and an output portion that outputs the control signal to the electromagnetic relay. The calculation unit determines whether a location region of the electromagnetic relay is a relay-freeze region, the location region being identified by the positional information of the vehicle, and, when the location region of the electromagnetic relay is a relay-freeze region, performs a freeze inhibiting process for preventing the electromagnetic relay from being frozen or defrosting the electromagnetic relay by opening and closing the electromagnetic relay and causing the electromagnetic relay to vibrate.

5 Claims, 4 Drawing Sheets

APPARATUS AND METHOD FOR INHIBITING ELECTROMAGNETIC RELAY FROM BEING FROZEN

This nonprovisional application is based on Japanese Patent Application No. 2020-177759 filed on Oct. 23, 2020 with the Japan Patent Office, the entire content of which is hereby incorporated by reference.

BACKGROUND OF THE INVENTION

Field of the Invention

The present disclosure relates to a technology for inhibiting an electromagnetic relay from being frozen.

Description of the Background Art

An electromagnetic relay switches in response to a movable terminal being displaced relative to a stationary terminal due to electromagnetic induction of an exciting coil. Such an electromagnetic relay is connected between the electric load and a power supply of a vehicle, for example, and used as a switch for toggling between supplying and shutting off the supply of a power to the electric load.

In particular, an electromagnetic relay that is mounted on a vehicle may be frozen under the environment in which the outside air temperature is low, such as early in the morning. As the electromagnetic relay being frozen as such hinders the connection between contact points of the movable terminal and the stationary terminal, the electromagnetic relay cannot exercise its function as a switch. Against this, some provision is demanded to be made.

Japanese Patent Laying-Open No. 2007-165406 discloses an apparatus for defrosting an electromagnetic relay. The apparatus includes a temperature sensor for detecting the temperature of the electromagnetic relay, and a voltage sensor for detecting a state of electrical discontinuity of the electromagnetic relay. Based on results of detection by these sensors, the apparatus determines whether the electromagnetic relay is frozen. If the electromagnetic relay is determined to be frozen, vibration is caused at the frozen portion of the electromagnetic relay by repeatedly opening and closing the electromagnetic relay, thereby defrosting the electromagnetic relay.

SUMMARY OF THE INVENTION

However, the apparatus disclosed in Japanese Patent Laying-Open No. 2007-165406 is required to include the temperature sensor for detecting the temperature of the electromagnetic relay and the voltage sensor for detecting a state of electrical discontinuity of the electromagnetic relay in order to determine whether the electromagnetic relay is frozen. Thus, an increased size of the apparatus and an increased cost can result.

The present disclosure is made to solve the above problem, and an object of the present disclosure is to prevent the electromagnetic relay from being frozen or defrost the electromagnetic relay, without requiring a temperature sensor for detecting the temperature of the electromagnetic relay and a voltage sensor for detecting a state of electrical discontinuity of the electromagnetic relay.

An apparatus for inhibiting an electromagnetic relay from being frozen according to the present disclosure includes: a first input portion that receives relay position information which allows identification of a location region of an electromagnetic relay; a calculation unit that generates a control signal for controlling the electromagnetic relay; and an output portion that outputs the control signal to the electromagnetic relay, wherein the calculation unit: determines whether the location region of the electromagnetic relay, identified by the relay position information, is a freeze region in which the electromagnetic relay is likely to be frozen; and performs a freeze inhibiting process for preventing the electromagnetic relay from being frozen or defrosting the electromagnetic relay, when the location region the electromagnetic relay is the freeze region.

A method for inhibiting an electromagnetic relay from being frozen according to the present disclosure includes: obtaining relay position information which allows identification of a location region of an electromagnetic relay; determining whether the location region of the electromagnetic relay, identified by the relay position information, is a freeze region in which the electromagnetic relay is likely to be frozen; and performing a freeze inhibiting process for preventing the electromagnetic relay from being frozen or defrosting the electromagnetic relay, when the location region of the electromagnetic relay is the freeze region.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, an embodiment according to the present disclosure will be described, with reference to the accompanying drawings. Note that the same reference sign is used to refer to the same or corresponding parts, and the description thereof will not be repeated.

Figure 1:
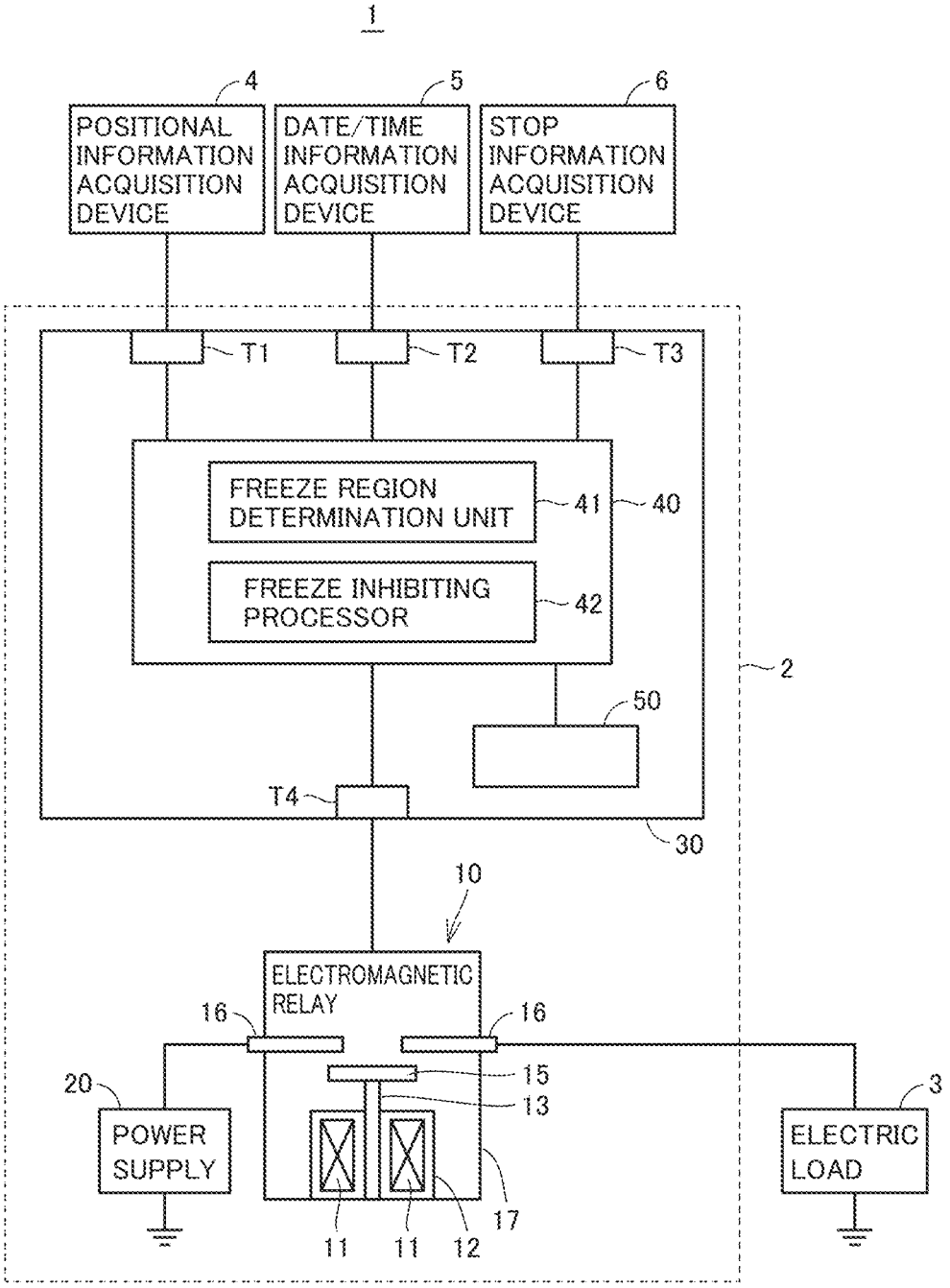
FIG. 1 is a diagram (Part 1) schematically showing one example configuration of a vehicle which includes a freeze inhibiting apparatus.

FIG. 1 is a diagram schematically showing one example configuration of a vehicle 1 which includes a freeze inhibiting apparatus according to the present embodiment.

The vehicle 1 includes a power supply system 2, an electric load 3, a positional information acquisition device 4, a date/time information acquisition device 5, and a stop information acquisition device 6. The power supply system 2 includes an electromagnetic relay 10, a power supply 20, and a control unit 30. Note that the control unit 30 corresponds to one example of a "freeze inhibiting apparatus" according to the present disclosure.

The positional information acquisition device 4 measures or externally obtains the positional information of the vehicle 1 and outputs it to the control unit 30. The positional information of the vehicle 1, measured or obtained by the positional information acquisition device 4, may be any information insofar as it allows identification of the country or region in which the vehicle 1 is located. Accordingly, the positional information of the vehicle 1, measured or obtained by the positional information acquisition device 4, may be information that indicates the country and region itself in which the vehicle 1 is located, or information indicating the latitude and the longitude of the location of the vehicle 1.

In the present embodiment, an already-available car navigation device equipped with a GPS (global positioning system), previously provided in the vehicle 1, is diverted as the positional information acquisition device 4. Accordingly, in the present embodiment, information indicating the latitude, longitude, altitude of the location of the vehicle 1 is used as the positional information of the vehicle 1.

Note that the positional information acquisition device 4 is not limited to a car navigation device, and may be equipment that includes location measurement capabilities by GPS (such as a drive recorder, a radar detector, a mobile terminal that is held by a user of the vehicle 1), for example. The positional information acquisition device 4 may also be equipment that uses a wireless LAN base station, such as a cellular tower and Wi-Fi (registered trademark), airwaves, beacons, vehicle-to-vehicle communications, etc. to obtain the positional information of the vehicle 1. The positional information acquisition device 4 may also be a service center that knows the location of the vehicle 1 if the vehicle 1 includes capabilities for communicating with such a service center.

The date/time information acquisition device 5 measures or externally obtains the current date/time information (date and time), and outputs it to the control unit 30. The information, obtained by the date/time information acquisition device 5, may be information about the current date, or information about a season (the spring, the summer, the fall, the winter) that the current date belongs to.

In the present embodiment, an already-available car navigation device equipped with GPS are diverted as the date/time information acquisition device 5 in the same way as the positional information acquisition device 4 described above. Note that the date/time information acquisition device 5 is not limited to a car navigation device, and may be equipment that uses a cellular tower, airwaves, etc. to obtain the date/time information. The date/time information acquisition device 5 can also be omitted if the control unit 30 included in the power supply system 2 is equipped with the clock function for measuring the current date/time.

The stop information acquisition device 6 obtains stop information that allows determination as to whether the vehicle 1 is stopped (referred to as being "left stopped") while the control system for the vehicle 1 is stopped. For example, the stop information acquisition device 6 can be configured of a starter key or a start button for switching between the activation and deactivation of the control system included in the vehicle 1.

The electric load 3 is equipment that is activated by a power supplied from the power supply system 2. For example, the electric load 3 is a motor which generates a power for driving the vehicle 1.

The power supply system 2 supplies or shuts off the supply of power to the electric load 3. The power supply system 2 includes the electromagnetic relay 10, the power supply 20, and the control unit 30, as described above.

The electromagnetic relay 10 includes an exciting coil 11, a yoke 12, a core 13, a movable terminal 15, and a pair of stationary terminals 16. The exciting coil 11 is wound on a bobbin or the like. The yoke 12 covers the perimeter of the exciting coil 11, and forms a magnetic circuit when the exciting coil 11 is energized. The core 13 is disposed inside the yoke 12, passing through the center of the turns of the exciting coil 11. The movable terminal 15 is secured to the core 13 via an insulating member not shown. The pair of stationary terminals 16 are disposed, each facing the movable terminal 15.

The components of the electromagnetic relay 10 are accommodated inside the housing 17, except for a portion of the stationary terminals 16 being exposed outside the housing 17. One of the stationary terminals 16 is electrically connected to the power supply 20, and the other one of which is electrically connected to the electric load 3.

When the exciting coil 11 is not energized, the core 13 is biased downward in FIG. 1 (the direction away from the stationary terminals 16) by a force not shown, such as a spring, ending up with the movable terminal 15 secured to the core 13 being separated from the stationary terminals 16 as shown in FIG. 1. This electrically disconnects the power supply 20 and the electric load 3 from each other, shutting off the supply of power to the electric load 3.

In contrast, when the exciting coil 11 is energized, electromagnetic induction of the exciting coil 11 generates a magnetic field, which forms a magnetic circuit between the yoke 12 and the core 13, exerting a force that moves the core 13 upward in FIG. 1 (the direction toward the stationary terminals 16) against the bias of the spring. As the core 13 moves upward in FIG. 1, the movable terminal 15 secured to the core 13 comes into contact with the stationary terminals 16. This electrically connects the power supply 20 and the electric load 3, causing a power to be supplied to the electric load 3.

The control unit 30 includes input portions T1, T2, and T3, an output portion T4, a calculation unit 40, and a storage unit 50.

The input portion T1 (a first input portion) is an input port for obtaining the positional information of the vehicle 1 from the positional information acquisition device 4. The input portion T2 is an input port for obtaining the current date/time information from the date/time information acquisition device 5. The input portion T3 is an input port for obtaining the stop information from the stop information acquisition device 6. The input portions T1 to T3 are connected to the calculation unit 40. The information input to the input portions T1 to T3 are sent to the calculation unit 40.

The output portion T4 is an output port connected to the calculation unit 40 and the electromagnetic relay 10, and for outputting a control signal generated by the calculation unit 40 to the electromagnetic relay 10.

The storage unit 50 is a storage medium that is connected to the calculation unit 40, and for storing information and programs that are used for calculations by the calculation unit 40. The storage unit 50 may be configured of a storage element, such as a read only memory (ROM) and a random access memory (RAM), etc.

The calculation unit 40 is connected to the input portions T1 to T3, the output portion T4, and the storage unit 50. The calculation unit 40 is configured of a central processing unit (CPU), for example. Based on signals input to the input portions T1 to T3 and the information and programs stored in the storage unit 50, the calculation unit 40 generates a control signal for controlling the electromagnetic relay 10, and outputs the control signal through the output portion T4 to the electromagnetic relay 10. This causes the electromagnetic relay 10 to be controlled in a mode in response to the control signal generated by the calculation unit 40.

The processing by the calculation unit 40 is performed by software processing, that is, by the calculation unit 40 reading and executing the programs stored in the storage unit 50. Note that the processing by the calculation unit 40 is not limited to the software processing, and may be performed using dedicated hardware (the electronic circuit).

While the control system of the vehicle 1 is being activated, the calculation unit 40 performs a process for energizing the exciting coil 11, thereby closing the electromagnetic relay 10 and supplying a power to the electric load 3. In contrast, while the control system of the vehicle 1 is being deactivated, the calculation unit 40 performs a process for de-energizing the exciting coil 11, thereby opening the electromagnetic relay 10 and shutting off the supply of power to the electric load 3.

<Process for Inhibiting Electromagnetic Relay 10 from being Frozen>

For example, due to demand on a car layout, the electromagnetic relay 10 can be disposed in the vehicle 1 at a location where temperature changes and humidity changes are relatively great, such as underneath the floor of the vehicle 1. If the electromagnetic relay 10 is disposed underneath the floor of the vehicle 1, for example, in a cold climate area or environment in which the outside air temperature is extremely low, such as early in the morning, moisture in the air or the like is built up and frozen on the components of the electromagnetic relay 10 inside the housing 17. In particular, since a portion of the stationary terminals 16 is exposed to the outside air external to the housing 17, as the outside air temperature goes down to a cryogenic temperature, a layer of ice may be formed, covering a contact surface of the stationary terminals 16 with the movable terminal 15. In this case, a poor contact may be caused between the stationary terminals 16 and the movable terminal 15 when the exciting coil 11 is energized, preventing the electromagnetic relay 10 from appropriately exercising its function as a switch. It is desired that some measures be taken to prevent such a poor contact due to the electromagnetic relay 10 being frozen.

As one of the measures, for example, it is contemplated to measure the temperature or a state of electrical discontinuity of the electromagnetic relay 10 to determine whether freezing is actually occurred in the electromagnetic relay 10, and, if freezing is determined to be occurred in the electromagnetic relay 10, repeatedly open and close the electromagnetic relay 10 to cause the electromagnetic relay 10 to vibrate, thereby defrosting the electromagnetic relay 10.

However, in order to determine whether freezing is occurred in the electromagnetic relay 10, the above approach requires a temperature sensor for detecting the temperature of the electromagnetic relay 10 and a voltage sensor for detecting a state of electrical discontinuity of the electromagnetic relay 10. Thus, problems, such as an increased size of the power supply system 2 and an increased cost, can result.

Thus, the control unit 30 according to the present embodiment is configured to perform a process for preventing the electromagnetic relay 10 from being frozen or defrosting the electromagnetic relay 10 (hereinafter, also referred to as a "freeze inhibiting process"), without requiring the temperature sensor for detecting the temperature of the electromagnetic relay 10 and the voltage sensor for detecting a state of electrical discontinuity of the electromagnetic relay 10.

Specifically, the storage unit 50, included in the control unit 30, pre-stores freeze region information defining (i) a region (also referred to as a "relay-freeze region") in which the electromagnetic relay 10 may be frozen and (ii) a season (referred to as a "relay-freeze season") during which the electromagnetic relay 10 is subjected to freezing in each relay-freeze region. For example, "Hokkaido region, Japan" is registered to the freeze region information as a relay-freeze region, and "January to February (the winter)" is registered as a relay-freeze season of that region. In addition, "Northeast China" may be registered to the freeze region information as a relay-freeze region, and "December to March (the winter)" may be registered as a relay-freeze season for that region.

The calculation unit 40 includes a freeze region determination unit 41 and a freeze inhibiting processor 42. When the vehicle 1 is determined to be left stopped based on the stop information input to the input portion T3, the freeze region determination unit 41 identifies the location region of the electromagnetic relay 10 based on the positional information of the vehicle 1 input to the input portion T1, and identifies the current season based on the date/time information input to the input portion T2. The freeze region determination unit 41 then references to the freeze region information stored in the storage unit 50 to determine whether the identified location region of the electromagnetic relay 10 is a relay-freeze region, and whether the identified current season is a relay-freeze season.

If the freeze region determination unit 41 determines that the location region of the electromagnetic relay 10 is a relay-freeze region and the current season is a relay-freeze season, the freeze inhibiting processor 42 repeatedly opens and closes the electromagnetic relay 10 at a predetermined timing for a predetermined duration, thereby causing the electromagnetic relay 10 to vibrate. The vibration of the electromagnetic relay 10 peripherally disperses the moisture built up on a contact surface of the stationary terminals 16 with the movable terminal 15 or a contact surface of the movable terminal 15 with the stationary terminals 16, making a layer of ice less likely to be formed between the movable terminal 15 and the stationary terminals 16. As a result, the electromagnetic relay 10 can be prevented from being frozen, without requiring the temperature sensor for detecting the temperature of the electromagnetic relay 10 or the voltage sensor for detecting a state of electrical discontinuity of the electromagnetic relay 10. If the electromagnetic relay 10 is already frozen, the electromagnetic relay 10 can be defrosted by its vibration.

Figure 2:
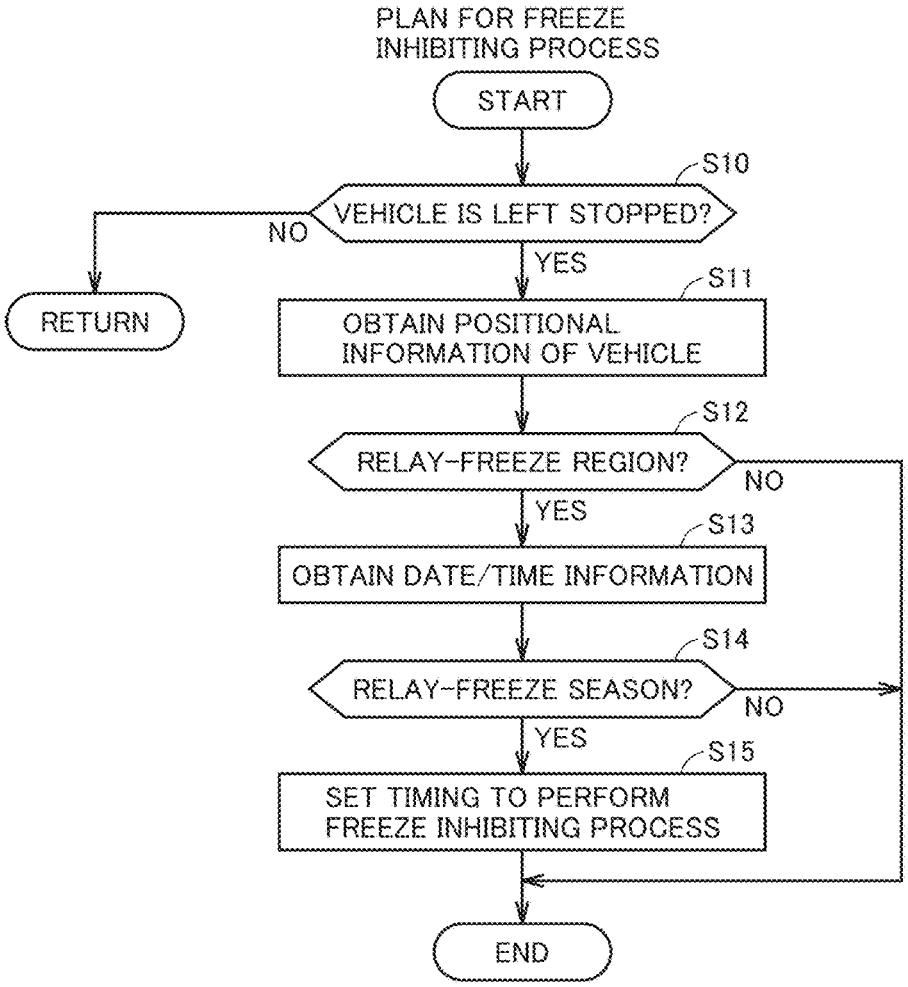
FIG. 2 is a flowchart (Part 1) showing one example procedure for the calculation unit to plan a freeze inhibiting process.

FIG. 2 is a flowchart showing one example procedure for the calculation unit 40 to plan the freeze inhibiting process.

The calculation unit 40 determines whether the vehicle 1 is left stopped, based on the stop information input to the input portion T3 (step S10). Note that when the vehicle 1 is left stopped, the electromagnetic relay 10 is opened and the supply of power to the electric load 3 is interrupted, as described above. If the vehicle 1 is not left stopped (NO in step S10), the calculation unit 40 skips the subsequent processes and returns the process.

If the vehicle 1 is left stopped (YES in step S10), the calculation unit 40 obtains the positional information of the vehicle 1 input to the input portion T1, as the positional information of the electromagnetic relay 10 (step S11).

Next, the calculation unit 40 identifies the location region of the electromagnetic relay 10 based on the obtained positional information of the vehicle 1, and references to the freeze region information stored in the storage unit 50 to determine whether the identified location region of the electromagnetic relay 10 is a relay-freeze region (step S12).

If the location region of the electromagnetic relay 10 is a relay-freeze region (YES in step S12), the calculation unit 40 obtains the date/time information input to the input portion T2 (step S13). The calculation unit 40 then identifies the current season based on the obtained date/time information, and references to the freeze region information stored in the storage unit 50 to determine whether the identified current season is a relay-freeze season for the location region of the electromagnetic relay 10 (step S14).

If the current season is a relay-freeze season (YES in step S14), the calculation unit 40 sets the timing to perform the freeze inhibiting process (step S15). For example, the calculation unit 40 plans the timing to perform the freeze inhibiting process so that the electromagnetic relay 10 is repeatedly opened and closed for a predetermined duration (e.g., a few minutes) after the elapse of a predetermined time period (e.g., a few hours) since the vehicle 1 has been left stopped.

Note that, in order to certainly defrost the electromagnetic relay 10, the electromagnetic relay 10 may be repeatedly opened and closed for a predetermined duration each time a predetermined time period elapses since the vehicle 1 has been left stopped. At this time, the maximum number of times the electromagnetic relay 10 is opened and closed each time the vehicle 1 is left stopped, may be limited in order to prevent excessive power consumption while the vehicle 1 is being left stopped.

After the timing to perform the freeze inhibiting process is set in step S15, the calculation unit 40 may go to sleep until the next freeze inhibiting process timing, and the calculation unit 40 may be timer-activated at that next freeze inhibiting process timing.

Figure 3:
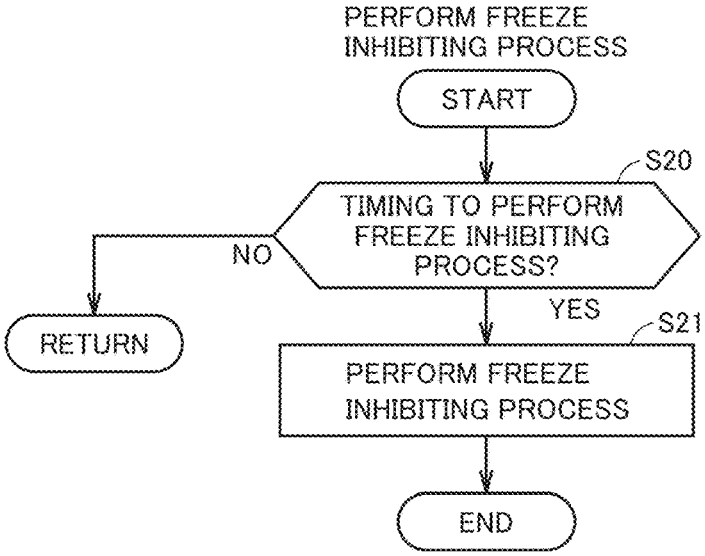
FIG. 3 is a flowchart showing one example procedure for the calculation unit to perform the freeze inhibiting process.

FIG. 3 is a flowchart showing one example procedure for the calculation unit 40 to perform the freeze inhibiting process that is planned by the processing of FIG. 2.

Initially, the calculation unit 40 determines whether it is the timing to perform the freeze inhibiting process set in step S15 of FIG. 2 (step S20). For example, in step S15 of FIG. 2, if the freeze inhibiting process timing is set to a time at which a predetermined time period elapses since the vehicle 1 has been left stopped, the calculation unit 40, in step S20, determines whether the elapsed time since the vehicle 1 has been left stopped, reaches a predetermined time period.

If it is not the timing to perform the freeze inhibiting process (NO in step S20), the calculation unit 40 skips the subsequent processes and returns the process.

If it is the timing to perform the freeze inhibiting process (YES in step S20), the calculation unit 40 performs the freeze inhibiting process (step S21). For example, as the freeze inhibiting process, the calculation unit 40 repeatedly opens and closes the electromagnetic relay 10 for a predetermined duration (e.g., a few minutes), thereby causing the electromagnetic relay 10 to vibrate.

As described above, the control unit 30 according to the present embodiment includes: the input portion T1 which receives input of the positional information of the vehicle 1; the calculation unit 40 for generating the control signal for controlling the electromagnetic relay 10; and the output portion T4 which outputs the control signal to the electromagnetic relay 10. The calculation unit 40 determines whether the location region of the electromagnetic relay 10, identified by the positional information of the vehicle 1, is a relay-freeze region. If the location region of the electromagnetic relay 10 is a relay-freeze region, the calculation unit 40 performs the freeze inhibiting process of opening and closing the electromagnetic relay 10 to cause the electromagnetic relay 10 to vibrate and thereby prevents the electromagnetic relay 10 from being frozen or defrosts the electromagnetic relay 10.

According to the above configuration, rather than detecting that the electromagnetic relay 10 is actually frozen by measuring the temperature or a state of electrical discontinuity of the electromagnetic relay 10, it is detected, based on the positional information of the vehicle 1 which includes the electromagnetic relay 10, that the electromagnetic relay 10 is likely to be frozen. If the electromagnetic relay 10 is detected to be likely to be frozen, the freeze inhibiting process is performed before the electromagnetic relay 10 is actually frozen. For this reason, the electromagnetic relay 10 can be prevented from being frozen. For this reason, the number of times or the duration that the electromagnetic relay 10 is required to be vibrated to inhibit the electromagnetic relay 10 from being frozen can be reduced, as compared to, for example, the case where the freeze inhibiting process is performed after the electromagnetic relay 10 is actually frozen and the ice is hardened. If the electromagnetic relay 10 is already being frozen, the electromagnetic relay 10 can be defrosted through the freeze inhibiting process. As a result, in the present embodiment, the electromagnetic relay 10 can be prevented from being frozen or defrosted, without having to provide a temperature sensor for detecting the temperature of the electromagnetic relay 10 and a voltage sensor for detecting a state of electrical discontinuity of the electromagnetic relay 10.

In particular, the calculation unit 40 according to the present embodiment further determines whether the current season is a relay-freeze season in the relay-freeze region. If the location region of the electromagnetic relay 10 is the relay-freeze region and the current season is the relay-freeze season, the calculation unit 40 performs the freeze inhibiting process.

According to the above configuration, whether to perform the freeze inhibiting process is determined, taking into an account not only the location region of the electromagnetic relay 10, but also the current season. For this reason, the determination can be made appropriately as to whether the freeze inhibiting process is needed, and the timing to perform the freeze inhibiting process.

<Variation 1>

Figure 4:
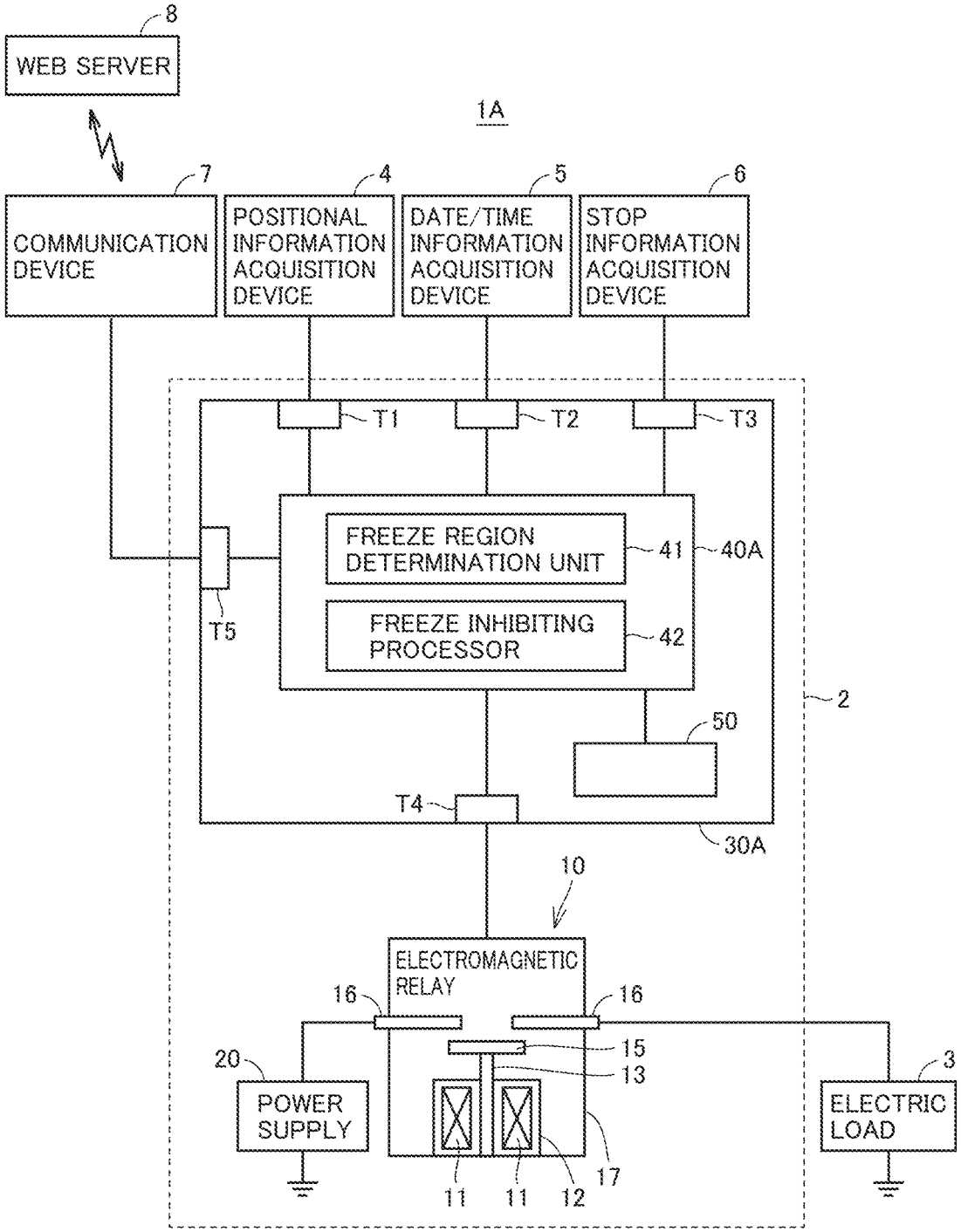
FIG. 4 is a diagram (Part 2) schematically showing one example configuration of a vehicle which includes the freeze inhibiting apparatus.

FIG. 4 is a diagram schematically showing one example configuration of a vehicle 1A which includes a freeze inhibiting apparatus according to Variation 1 of the present embodiment. The vehicle 1A is the same as the vehicle 1 described above, except for additionally including a communication device 7, and a control unit 30A instead of the control unit 30. The other configuration of the vehicle 1A is the same as the vehicle 1, and the detailed description will therefore not be repeated here.

The communication device 7 is wirelessly communicable with a web server 8 provided outside the vehicle 1, and downloads weather forecast information from the web server 8. Note that the weather forecast information includes the forecast information about the temperature and the humidity of a respective region. The weather forecast information at least includes the information about the minimum temperature of a respective region within a predetermined time period (e.g., twelve hours) from the present time.

The control unit 30A is the same as the control unit 30 described above, except for additionally including an input portion T5 (a second input portion), and a calculation unit 40A instead of the calculation unit 40. The input portion T5 is an input port for obtaining the weather forecast information downloaded by the communication device 7 from the web server 8. The calculation unit 40A plans the freeze inhibiting process based on the weather forecast information input to the input portion T5.

Figure 5:
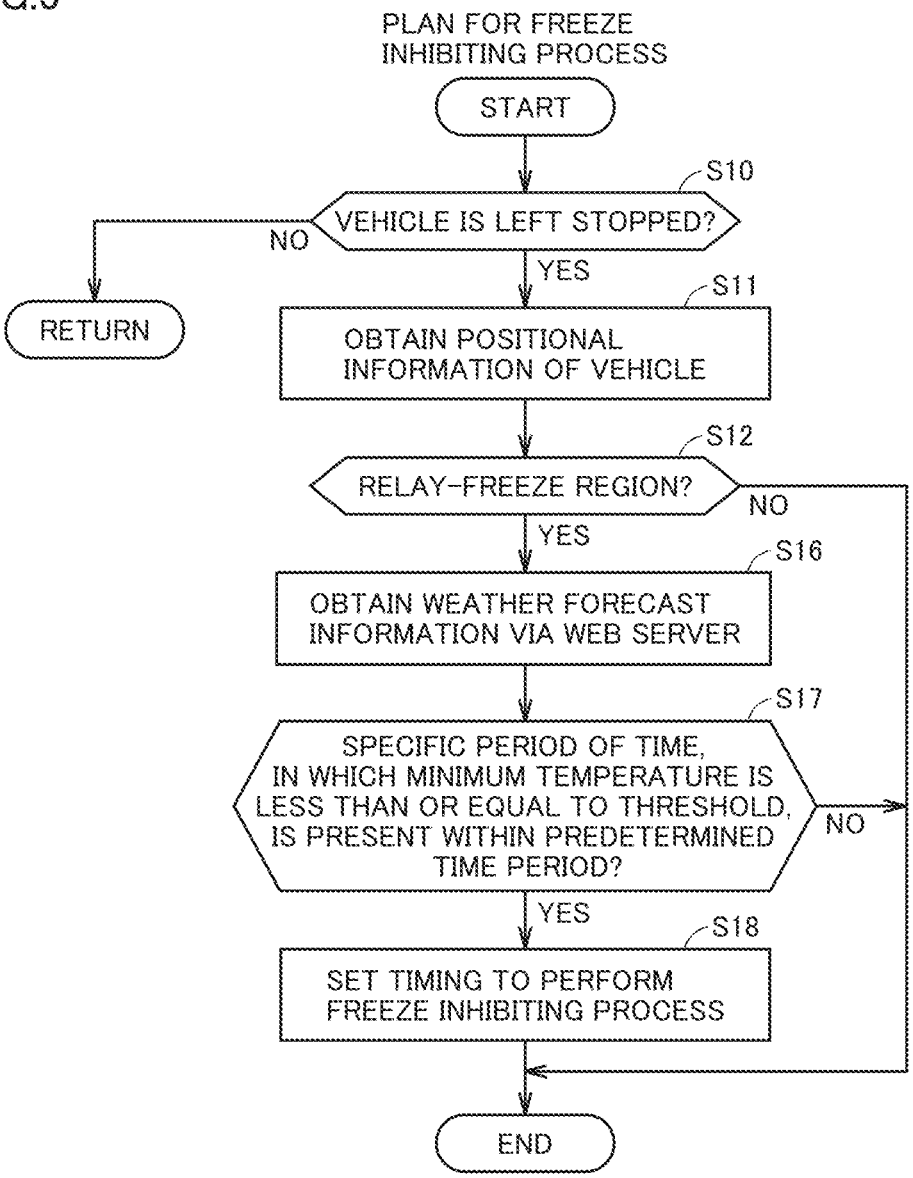
FIG. 5 is a flowchart (Part 2) showing one example procedure for the calculation unit to plan the freeze inhibiting process.

FIG. 5 is a flowchart showing one example procedure for the calculation unit 40A to plan the freeze inhibiting process. Note that the steps shown in FIG. 5 having the same numbers as those shown in FIG. 2 have been described already. Therefore, the description will not be repeated here.

If the vehicle 1 is left stopped (YES in step S10), the calculation unit 40A obtains the positional information of the vehicle 1 input to the input portion T1, as the positional information of the electromagnetic relay 10 (step S11).

If the location region of the electromagnetic relay 10, identified based on the obtained positional information of the vehicle 1, is a relay-freeze region (YES in step S12), the calculation unit 40 obtains, via the web server 8, the weather forecast information of the identified location region of the electromagnetic relay 10 (step S16). Note that the weather forecast information includes the information about the minimum temperature of the identified location region of the electromagnetic relay 10 within a predetermined time period (e.g., twelve hours) from the present time, as described above.

Next, based on the weather forecast information obtained in step S16, the calculation unit 40A determines whether a specific period of time, in which the minimum temperature is less than or equal to a threshold (e.g., below freezing, or a few degrees Celsius higher than below freezing), is present within the predetermined time period from the present time, (step S17).

If the specific period of time is present in which the minimum temperature is less than or equal to the threshold (YES in step S17), the calculation unit 40A sets the timing to perform the freeze inhibiting process (step S18). For example, the calculation unit 40A plans the timing to perform the freeze inhibiting process so that the electromagnetic relay 10 is repeatedly opened and closed for a predetermined duration (e.g., a few seconds) in a predetermined time period that includes the specific period of time in which the minimum temperature is less than or equal to the threshold.

Note that the procedure which the calculation unit 40A carries out to perform the freeze inhibiting process planed through the processing shown in FIG. 5 is the same as the procedure described with respect to FIG. 3 described above, and the detailed description will therefore not be repeated here.

As described above, the calculation unit 40A may determine whether to set the timing to perform the freeze inhibiting process, based on the positional information of the vehicle 1 input to the input portion T1 and the weather forecast information input to the input portion T5.

<Variation 2>

In the embodiment described above, the description has been given with reference to preventing the electromagnetic relay 10 from being frozen or defrosting the electromagnetic relay 10 by the opening and closing operations of the electromagnetic relay 10 and thereby causing the electromagnetic relay 10 to vibrate in the freeze inhibiting process.

However, the approach to prevent the electromagnetic relay 10 from being frozen or defrost the electromagnetic relay 10 is not limited to causing the electromagnetic relay 10 to vibrate by the opening and closing operations of the electromagnetic relay 10.

For example, a dedicated vibrator may be provided in the vicinity of the electromagnetic relay 10 and the electromagnetic relay 10 may be vibrated by the vibrator.

Also, in order to release even a rigid frozen state of the electromagnetic relay 10, the electromagnetic relay 10 may be prevented from being frozen or defrosted by applying to the electromagnetic relay 10 a voltage that is higher than the excitation voltage typically applied to the electromagnetic relay 10.

The electromagnetic relay 10 may also be prevented from being frozen or defrosted by generation of heat by applying to the electromagnetic relay 10 a voltage that is low to an extent that a normal switching operation is not performed or by applying a voltage to the electromagnetic relay 10 for a short time.

A heater may also be provided in the vicinity the electromagnetic relay 10 and the electromagnetic relay 10 may be defrosted or prevented from being frozen by heating the electromagnetic relay 10 with the heater.

A fan may also be provided in the vicinity the electromagnetic relay 10, and the electromagnetic relay 10 may be defrosted or prevented from being frozen by blowing an air at the electromagnetic relay 10 with the fan.

If the electromagnetic relay 10 is disposed within the vehicle 1, the electromagnetic relay 10 may be used in conjunction with the air-conditioner of the vehicle 1 to increase the temperature inside the vehicle 1, and the electromagnetic relay 10 may thereby be prevented from being frozen or may be defrosted.

<Variation 3>

A user of the vehicle 1 may manually change (i) a specific period of time per run of the freeze inhibiting process, (ii) the number of times the freeze inhibiting process is performed, and (iii) the time intervals at which the freeze inhibiting process is performed. For example, when the user of the vehicle 1 can manually switch control modes between a normal mode and a cold-climate-area mode, the freeze inhibiting process may be planned so that the freeze inhibiting process is performed more frequently in the cold-climate-area mode than in the normal mode.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An apparatus for inhibiting an electromagnetic relay from being frozen, the apparatus comprising:

a first input portion that receives relay position information which allows identification of a location region of an electromagnetic relay;

a calculation unit that generates a control signal for controlling the electromagnetic relay; and an output portion that outputs the control signal to the electromagnetic relay, wherein the calculation unit:

determines whether the location region of the electromagnetic relay, identified by the relay position information, is a freeze region in which the electromagnetic relay is likely to be frozen; and performs a freeze inhibiting process for preventing the electromagnetic relay from being frozen or defrosting the electromagnetic relay, when the location region of the electromagnetic relay is the freeze region.

2. The apparatus according to claim 1, wherein the electromagnetic relay is included in a vehicle equipped with a device that obtains vehicle position information, and the vehicle position information is input to the first input portion, as the relay position information, the apparatus further comprising a storage unit that stores freeze region information defining the freeze region and a freeze season in which the electromagnetic relay is subjected to freezing in the freeze region, wherein the calculation unit:

determines whether the location region of the electromagnetic relay is the freeze region, based on the relay position information;

determines whether a current season is the freeze season in the freeze region; and performs the freeze inhibiting process when the location region of the electromagnetic relay is the freeze region and the current season is the freeze season in the freeze region.

3. The apparatus according to claim 1, further comprising:

a second input portion that receives weather forecast information from an external server, wherein the calculation unit:

determines whether the location region of the electromagnetic relay is the freeze region, based on the relay position information;

determines, based on the weather forecast information, whether a specific period of time, in which a minimum temperature is less than or equal to a threshold, is present within a predetermined time period; and performs the freeze inhibiting process when the location region of the electromagnetic relay is the freeze region and the specific period of time, in which the minimum temperature is less than or equal to the threshold, is present within the predetermined time period.

4. The apparatus according to claim 1, wherein the calculation unit causes the electromagnetic relay to vibrate by repeatedly opening and closing the electromagnetic relay for a predetermined duration in the freeze inhibiting process.

5. A method for inhibiting an electromagnetic relay from being frozen, the method comprising:

obtaining relay position information which allows identification of a location region of an electromagnetic relay;

determining whether the location region of the electromagnetic relay, identified by the relay position information, is a freeze region in which the electromagnetic relay is likely to be frozen; and performing a freeze inhibiting process for preventing the electromagnetic relay from being frozen or defrosting the electromagnetic relay, when the location region of the electromagnetic relay is the freeze region.

* * * * *